United States Patent [19]

Matsuura

[11] Patent Number: 4,524,974

[45] Date of Patent: Jun. 25, 1985

[54] GOLF TEE

[76] Inventor: Norio Matsuura, 6-10-16, Mino-o, Mino-o city, Osaka, Japan, 562

[21] Appl. No.: 570,885

[22] Filed: Jan. 16, 1984

[30] Foreign Application Priority Data

Feb. 22, 1983 [JP] Japan ..... 58-23839[U]

[51] Int. Cl.[3] ..... A63B 57/00

[52] U.S. Cl. ..... 273/207

[58] Field of Search ..... 273/207, 26 B, 33

[56] References Cited

U.S. PATENT DOCUMENTS

| | | | |
|---|---|---|---|
| 1,679,579 | 8/1928 | Lundy | 273/33 |
| 1,783,733 | 12/1930 | Manassero | 273/207 |
| 1,807,377 | 5/1931 | Brokaw | 273/207 |
| 2,011,203 | 8/1935 | Seiki | 273/33 |
| 2,146,736 | 2/1939 | Hammond et al. | 273/207 |
| 2,470,817 | 5/1949 | Hendricks | 273/207 |
| 2,839,305 | 6/1958 | Lerick | 273/207 |
| 3,414,268 | 12/1968 | Chase | 273/207 |
| 4,399,996 | 8/1983 | Boyce | 273/26 B |

FOREIGN PATENT DOCUMENTS

| | | | |
|---|---|---|---|
| 109972 | 3/1940 | Australia | 273/207 |
| 401453 | 11/1933 | United Kingdom | 273/207 |

*Primary Examiner*—Richard C. Pinkham
*Assistant Examiner*—T. Brown
*Attorney, Agent, or Firm*—George B. Oujevolk

[57] ABSTRACT

A golf tee comprising a peg member having one end adapted to be thrust into the ground, a head member for placement of a golf ball, a coil spring made of thermo treated reinforced engineering plastic provided between the peg member and the head member, and it is characterized in that an axial bore is formed in the head member and one end of the coil spring is secured inside bore of the head member and the other end of the coil spring is secured with the peg member, the two members are united by inserting a convex portion of the peg member into a concave portion of the head member. These two members are attracted to each other by the force of the spring.

1 Claim, 4 Drawing Figures

GOLF TEE

BACKGROUND OF THE INVENTION

1. Field of the Invention

The present invention relates to an improvement of a golf tee, in which a head member for placement of golf ball and a coil spring made of thermo treated reinforced engineering plastic are installed coiling outside said members or inserted into a concave portion of the member.

2. Brief Description of the Prior Art

The conventional golf tee, as shown in FIG. 1. (*a*), is integrally formed comprising the peg member 1 to be thrust into the ground and the head member 2 for placement of a golf ball, regardless of whether the golf tee is made of synthetic resin or wood. Because of such a structure, the golf tee tends to be hit off from the ground and drop into the grass bush when a golf ball and tee are hit by a golf club. This makes it difficult for the golf player to find the lost peg and leads to an undesirable delay in the game.

In an attempt to solve this problem, a golf tee comprising the head member for placement of a golf ball, a peg member, a coil spring 3 provided between both members, is publicly known by-Japanese Utility Model Disclosure to the public No. Sho 51-129370.

In U.S. Pat. No. 2,470,817 in which a golf tee has been shown and publicly known, the golf tee comprises one rubber thread connected with the tee members, which tends to cut off the rubber thread when it is hit hard by the golf club.

Another U.S. Pat. No. 2,839,304 shows a golf tee device comprising a head member for placement of a golf ball, a peg member and a coil spring provided between both members to connect both members. The coil spring used for the golf tee shown by U.S. Pat. No. 2,839,304 is made of steel so that the coil spring has a drawback to be easily deformed by a hard drive exeeding the elasticity limit and it becomes unusable.

APPLICABILITY OF THE INVENTION

The conventional coil spring is made of steel formed in spiral with a necessary treatment and cut in a given length to use. A shot impact by the golf club swing creates enormous destructive power exceeding a limit of elasticity of the coil spring which deprives the spring of its restoration property to its original state. In the light of this, much research and tests by this applicant have found that the elastic property of thermo treated reinforced engineering plastic provides far better elasticity, more than twice as much as the steel-make coil spring does. This is the reason why the engineering plastic coil spring is used to improve the golf tee.

SUMMARY OF THE INVENTION

The present invention provides a golf tee which comprises a peg member having one end adapted to be thrust into the ground, a head member for placement of a golf ball and an elastic coil spring made of thermo treated reinforced engineering plastic provided between the peg member and the head member, and which is characterized in that an axial bore is formed in the head member. Said coil spring is inserted in the bore and one end of said coil spring is secured in said peg member. By inserting the convex portion of said peg member into the concave portion of said head member and attracted to each other by the coil spring, the two members abut each other.

OBJECTS OF THE INVENTION

Thus, an object of the present invention is to present a golf tee in which the coil spring made of thermo treated reinforced engineering plastic is provided as the elastic member between a head member for placement of a golf ball and a peg member.

The head member and the peg member are connected with the coil spring made of thermo treated reinforced engineering plastic by inserting one end of said coil spring into the concave portion of the head member.

Another feature is to provide a golf tee which will remain thrust into the ground by absorbing the impact through the work of the coil spring made of thermo treated reinforced engineering plastic even when the head of the club strikes the ball at a place other than the center portion of the ball on the tee.

Another technical feature is to provide a golf tee comprising a head member for placement of a golf ball and a peg member and a coil spring made of thermo treated reinforced engineering plastic provided between both members to connect or disconnect freely. Also, a nob is installed in the golf tee in order to protect the coil spring function when the golf tee thrust into the ground is taken off out of the ground.

The engineering plastic is the most ideal material to be used for the coil spring in the present invention. In making the coil spring and a nob, the engineering plastic material is necessarily used in coiling around the bar shape tool in a necessary diameter, and is heated in an atmosphere of 200 C. degrees in a furnace tunnel by travelling through the inside the furnace tunnel. The plastic to be used is polyamide or polyether blended with a non flamable agent. The head member for placement of a golf ball is manufactured of a rubber material or plastic material and forms a portion for placement of a golf ball. The peg member is manufactured of a synthetic resin, a synthetic rubber or wood.

DETAILED DESCRIPTION

Figure 1:
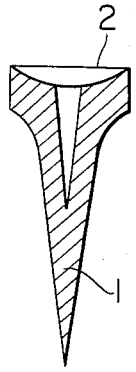
FIGS. 1(*a*) and 1(*b*) are, respectively, a cross sectional view and a side view of known golf tees.
Figure 1:
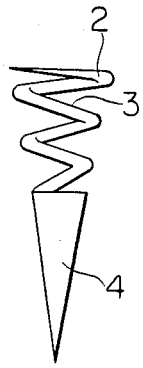
Figure 2:
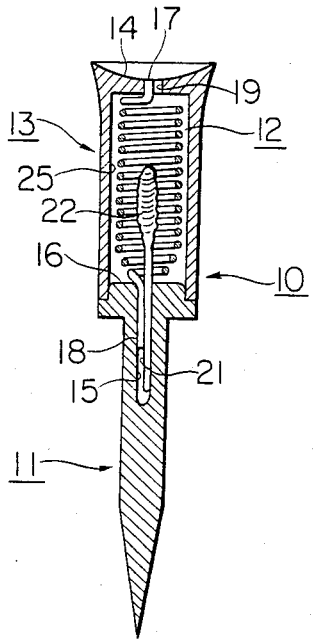
FIG. 2 is a cross sectional view of a golf tee of the present invention, comprising a portion for placement of a golf ball, a member having a hollow section inside the member.
Figure 3:
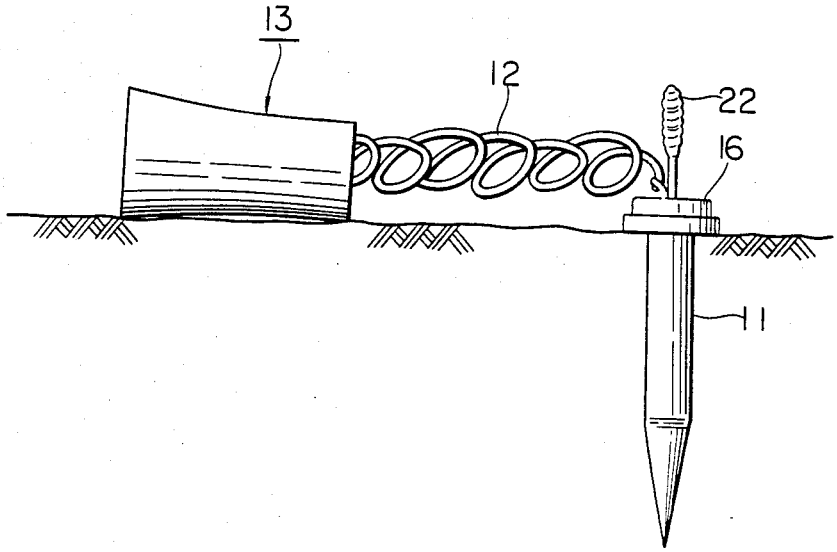
FIG. 3 is a front view illustrating a disclosed state of a nob of a holder at the time of having just teed off.

Now, preferred embodiments of the present invention will be described with reference to the drawings. Numeral 10 designates a golf tee. The golf tee 10 may take any suitable form. The golf tee 10 comprises an elongated peg member 11 with a pointed end, a coil spring 12, a head member 13 for placement of a golf ball.

The peg member 11 is made of a plastic material forming a pin shape at the front end of the peg. A recess 15 is provided which axially extends from the upper end of the peg member, and convex surface 16 is formed at the upper end of the peg. The coil spring 12 may be made out of a special engineering plastic thread by coiling around the outer surface periphery of the bar tool in a given diameter and it is given a travelling heat treatment in an electric furnace tunnel in an atmosphere of C. 200 degrees. Simultaneously an upper end 17 and a lower end 18 of the coil spring are formed. The both ends 17, 18 of the coil spring are inserted into holes 15, 19 of the portion for placement of a golf ball 13 and the peg portion 11 respectively to fix firmly with a glue or high frequency micro wave heat treatment. Numeral 22 designate a plastic-make holder, i.e., a nob which lower end 21 is inserted into center hole 15. The nob 22 must be smaller than the diameter of the coil spring spiral 12 installed inside the head member of the golf tee. Numeral 25 designate a wall of the head member forming a hollow support on which top there is a small through-hole 19. The coil spring 12 is placed into inside hollow of the head member of the golf tee.

At the time of teeing off, the peg 11 of the golf tee 10 is thrust into the ground in the same manner as the conventional tees. A golf ball is placed on the concaved surface 14 of the head member 13 of the golf tee. When a part of the driver head has shot the head member 13 at an upper portion of the golf tee, only the golf ball will fly off, and the head member 13 will be disconnected out of the peg member 11 to drop down on the ground, but it will usually swing back to the original position by the elastic property of the coil spring provided between the head member and the peg member. When the golf tee thrust into the ground is taken out of, a nob 22 is used to pick up the peg member 11 out of the ground. The head member 13 and the peg member are connected by inserting a a convex portion of the peg member 11 into a concave portion of the head member 13, and the coil spring is restored to the original state to use it repeatedly.

Therefore, there will be no need to look for the golf tee during the game. It becomes possible to proceed immediately. This will promote the pleasure of golfing. The embodiment of the golf tee in the present invention comprises a head member and a peg member as the upper part and the lower part which are separate. By this means, only the peg member is thrust into the ground to securely hold the tee when a golf game played. Therefore, even when the tee shot is made, the tee-shot resistance is scarcely felt and the shot impact works directly on the ball effectively. Thus, the flying distance of the ball will be further extended.

What is claimed is:

1. A golf tee (10) comprising in combination:

(a) an elongated cylindrical peg member (11) with a top section and a pointed lower end designed to be placed vertically in the ground, said top section including an outer flange and an inner stepped portion;

(b) a cylindrical head member having a concave cup-shaped top, designed to receive a golf ball and a cylindrical hollow body portion in said head member, said body portion supporting said top, an anchor hole (17) at the inner bottom of said concave cup-shaped top, a circular open bottom to said hollow body portion resting on said flange and over the stepped portion;

(c) an axial center space in said peg member, a plastic knob (22) with a stem portion, said stem portion being held in said center space, and the knob (22) protruding into the hollow body portion; and, (d) a plastic coil spring (12) having one end held by said stem in said space (15) and the other end extending through said axial bore to the anchor hole (17), the diameter of the coil spring (15) being greater than that of the knob (22); whereby when a golf ball is hit on the tee, the head member will tend to fly off but is restrained by the spring, and, to pull the peg of the golf tee out of the ground, the knob is used to avoid distending the plastic coil spring.

* * * * *